United States Patent [19]

Sekiguchi et al.

[11] Patent Number: 4,488,533

[45] Date of Patent: Dec. 18, 1984

[54] ATMOSPHERIC PRESSURE COMPENSATION SYSTEM FOR EXHAUST GAS RECIRCULATION

[75] Inventors: Kiyonori Sekiguchi, Aichi; Takeshi Tanaka, Toyohashi; Michio Kawagoe, Susono; Mitsumasa Yamada, Mishima, all of Japan

[73] Assignees: Nippon Soken, Inc., Nishio; Toyota Jidosha Kabushiki Kaisha, Toyota, both of Japan

[21] Appl. No.: 599,276

[22] Filed: Apr. 11, 1984

[30] Foreign Application Priority Data

Apr. 11, 1983 [JP] Japan ..... 58-63416

[51] Int. Cl.[3] ..... F02M 25/06

[52] U.S. Cl. ..... 123/569; 123/571

[58] Field of Search ..... 123/569, 571, 568

[56] References Cited

U.S. PATENT DOCUMENTS

| | | | |
|---|---|---|---|
| 4,375,800 | 3/1983 | Otsuka et al. | 123/571 |
| 4,387,693 | 6/1983 | Romblom | 123/569 |
| 4,399,799 | 8/1983 | Romblom et al. | 123/569 X |
| 4,411,242 | 10/1983 | Igashira et al. | 123/569 |

*Primary Examiner*—Wendell E. Burns

*Attorney, Agent, or Firm*—Cushman, Darby & Cushman

[57] ABSTRACT

An atmospheric pressure compensation system for an exhaust gas recirculation (EGR) of an internal combustion engine comprises a vacuum source for generating vacuum of a substantially constant absolute value, an EGR valve for regulating the gas flow passing through an EGR passage by means of the vacuum, an atmospheric pressure compensation valve for opening and closing a passage for transmitting the vacuum from the vacuum source to the EGR valve, a control circuit for detecting the engine running conditions and generating a control signal, and an actuator for contributing to actuate the compensation valve in response to the control signal. The atmospheric pressure compensation valve comprises a valve body defining at least two chambers partitioned by a diaphragm. The atmospheric pressure is introduced into one of the chambers, while the substantially constant vacuum from the vacuum source is introduced into the other chamber. A servo valve is operatively connected to the diaphragm and to the actuator. The servo valve is subjected to a force of the actuator and the pressure difference between the atmospheric pressure and the substantially constant vacuum.

6 Claims, 6 Drawing Figures

ATMOSPHERIC PRESSURE COMPENSATION SYSTEM FOR EXHAUST GAS RECIRCULATION

BACKGROUND OF THE INVENTION

1. Field of the Invention

The present invention relates to an exhaust gas recirculation (EGR) system of an internal combustion engine, and more particularly, to an atmospheric pressure compensation system for adjusting a control vacuum for controlling an EGR valve in response to changes of the atmospheric pressure. The atmospheric pressure compensation system of this invention can be advantageously employed in an EGR system of a diesel-type engine.

2. Description of the Prior Art

Conventional atmospheric pressure compensation systems of vacuum control valves are known in which metal bellows are used for detecting the atmospheric pressure, and ceramic diaphragms are used for confining the absolute vacuum, so that the atmospheric compensation is carried out by utilizing the pressure difference between the absolute vacuum and atmospheric pressure. However, such conventionally known systems have several disadvantages, such as, they require expensive parts, and it is technically difficult to enclose or confine the absolute vacuum pressure, thereby also requiring high technical costs.

SUMMARY OF THE INVENTION

An object of the present invention is, therefore, to provide an atmospheric pressure compensation system of a vacuum control valve capable of overcoming the disadvantages in the above-mentioned prior art.

Another object of the present invention is to provide an atmospheric pressure compensation system of a vacuum control valve capable of reducing the cost of the parts thereof and of being easily manufactured in the pertinent technical field.

According to the present invention, there is provided an atmospheric pressure compensation system for an exhaust gas recirculation of an internal combustion engine comprising: a vacuum source for generating vacuum pressure of a substantially constant absolute value; an EGR valve for regulating the gas flow passing through an EGR passage by means of the vacuum pressure from the vacuum source; an atmospheric pressure compensation valve for opening and closing a passage for transmitting the vacuum pressure from the vacuum source to the EGR valve; a control circuit for detecting the engine running conditions and generating a control signal; and an actuator means for contributing to actuate the atmospheric pressure compensation valve in response to the control signal. The atmospheric pressure compensation valve comprises a valve body defining therein at least two chambers, the atmospheric pressure being introduced into one of the chambers, while the substantially constant vacuum pressure from the vacuum source is introduced into the other chamber, means for movably partitioning between the two pressure chambers, and movable valve means for opening and closing the vacuum transmitting passage, operatively connected to the partitioning means and to the actuator, so that the valve means is subjected to the actuating force of the actuator and the pressure difference between the atmospheric pressure and the constant vacuum pressure. The movably partitioning means may advantageously comprise at least one diaphragm, and the movable valve means may advantageously consist of a servo valve by which the EGR valve is selectively connected to either the constant vacuum source or the atmosphere through the atmosphere chamber.

The servo valve may advantageously comprise a first valve element, a second valve element movably disposed in the valve body and formed as a casing for movably receiving the first valve element, the casing being communicated with the atmosphere chamber into which the atmospheric pressure is introduced. A spring is disposed in the casing for urging the first valve element in one direction within its stroke so as to close the second valve element, which is operatively connected to the diaphragm means as well as to the actuator. By moving in one direction, the second valve element allows the first valve element to close a vacuum pump port connected to the constant vacuum source and to open the second valve element to introduce the atmospheric pressure into the EGR valve, and by moving in the other direction, allows the first valve element to open the vacuum pump port to introduce the constant vacuum in to the EGR valve and to close the second valve.

DESCRIPTION OF THE PREFERRED EMBODIMENTS

The drawings show several embodiments of an atmospheric pressure compensation system of a vacuum control valve, according to the present invention, which can be advantageously applied to the exhaust gas recirculation (hereinafter referred to as "EGR") of diesel-type internal combustion engines.

Figure 1:
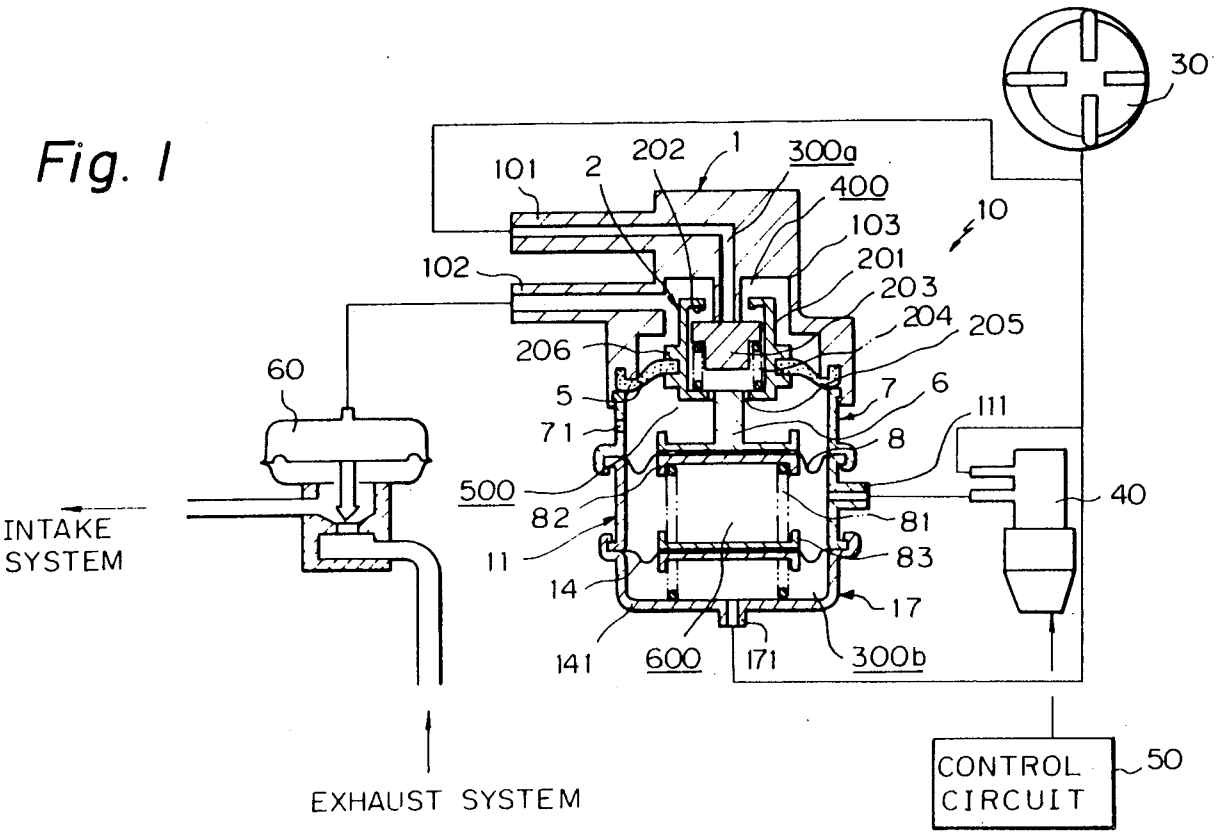
FIG. 1 is a cross-sectional view of a first embodiment of the present invention.

FIG. 1 shows a vertical cross-sectional view of a first embodiment of a vacuum control valve of the present invention, in which a valve body 10 of the vacuum control valve includes a port housing 1, a servo valve 2, a first diaphragm 5, an atmosphere chamber housing 7, a second diaphragm 8, a vacuum signal housing 11, a third diaphragm 14, and a pump vacuum housing 17.

The port housing 1 can be made of any suitable known material, such as iron (Fe), aluminium (Al), phenol resin, or the like, and comprises a vacuum pressure port 101 for introducing a vacuum pressure from a vacuum source, such as a vacuum pump 30, inside the valve body 10, and a control vacuum port 102 for supplying the control vacuum modulated by the valve body 10 to an EGR valve 60, which regulates the gas flow passing through an EGR passage. The vacuum pressure port 101 is connected to a first vacuum chamber **300*a* formed within the port housing 1. An extension 103 is connected to the first vacuum chamber 300*a* and projects into the port housing 1. The control vacuum port 102 connects a control vacuum chamber 400 formed within the port housing 1 to the EGR valve 60**.

The tip of the extension 103 is in contact with a first valve element 203 made of elastomeric material, such as rubber, located within a casing-like second valve element 201 of a substantially cylindrical shape having a bottom wall. A first spring 204 is located between the first and second valve elements 203 and 201. This spring urges the first valve element 203 into contact with a jaw portion 202 (in FIG. 1, the first valve element 203 is positioned away from the jaw portion 202) formed at an open end of the second valve element 201, which has in the side wall thereof an atmosphere communicating port 205 communicating the inside of the second valve element 201 with the atmosphere through an atmosphere chamber 500.

The first diaphragm 5 has an inner periphery firmly secured to a holding portion 206 of the second valve element 201, and an outer periphery firmly held between the port housing 1 and the atmosphere chamber housing 7. The first diaphragm 5 is made of any suitable elastomeric material to allow the up-and-down movement of the second valve element 201 in FIG. 1. These valve members, such as the second valve element 201, first spring 204, first valve element 203, and first diaphragm 5 constitute the servo valve 2.

The atmosphere chamber housing 7 is provided in the side wall of the servo valve 2 with an atmosphere port 71 for communicating the atmosphere chamber 500 defined within the atmosphere chamber housing 7 with the outside atmospheric environment. The upper end of the atmosphere chamber housing 7 is, as seen in FIG. 1, rigidly secured by caulking to the port housing 1, and the lower end thereof cooperates, as seen in FIG. 1, with the vacuum signal housing 11 to rigidly secure, such as by caulking, the outer periphery of the second diaphragm 8. The inner periphery of the second diaphragm 8 is supported by a first pushing plate 82 which is connected to the second valve element 201 by a connecting shaft 6.

The vacuum signal housing 11 defines per se a signal vacuum chamber 600 serving as an actuator and has a signal vacuum port 111 provided in the side wall thereof for communicating the signal vacuum chamber 600 with a vacuum control valve 40, which receives a signal from a control circuit 50 of the engine (not shown) for detecting the revolutional speed (RPM) and fuel quantity and supplies a signal vacuum to the signal vacuum chamber 600. One end of the vacuum signal housing is engaged with the atmosphere housing 7, as mentioned above, and the other end is engaged with a vacuum pump housing 17, so as to rigidly secure the outer periphery of a third diaphragm 14. The inner periphery of the third diaphragm 14 is supported by a second pushing plate 83, and a second spring 82 is disposed between the first and second pushing plates 82 and 83.

The vacuum pump housing 17 has a substantially cup-shaped configuration and defines therein a second pump chamber **300*b*. The vacuum pump housing 17 is provided with a vacuum pump port 171 in the bottom wall for communicating the second vacuum pump chamber 300*b* with the above-mentioned vacuum source 30. A third spring 141 is disposed between the second pushing plate 83 and the bottom wall of the vacuum pump housing 17**.

Operation of the atmospheric compensation system of vacuum control valve constituted as mentioned above will now be described.

Before starting the engine of a motor vehicle (not shown), all the pressure chambers are under atmospheric pressure. When the motor vehicle engine starts in this condition, the vacuum pump 30, for example, a vane type pump, starts to rotate, and vacuum pump pressure is generated and is applied to the first and second vacuum pump chambers **300*a* and 300*b*, since the vacuum pump ports 101 and 171 are connected to the vacuum pump 30. The third diaphragm 14 is, therefore, moved against the third spring 14 toward the bottom wall of the vacuum pump housing 17, i.e., downward in FIG. 1. The downward movement of the third diaphragm 14 is transmitted through the second pushing plate 13, the second spring 81, and the first pushing plate 82 to the connecting shaft 6, which moves downward in FIG. 1, causing the downward movement of the second valve element 201 in FIG. 1. Consequently, the jaw portion 202 of the second valve element 201 comes into contact with the first valve element 203 so that, at this precise moment, the control vacuum chamber 400** is disconnected from both the atmosphere and the vacuum pressure.

The RPM and the fuel quantity of the motor vehicle engine are detected in the detecting circuit 50. This circuit 50 outputs a signal to the vacuum control valve 40, which in turn generates a control vacuum signal that is introduced into the signal vacuum chamber 600 through the signal vacuum port 111. The second diaphragm 8 is, therefore, moved against the second spring 81 toward the vacuum pump housing 17, i.e., downward in FIG. 1, and the connecting shaft 6 is simultaneously pulled downward in FIG. 1 so as to pull down the second valve element 301 in FIG. 1. The jaw portion 202 is, consequently, moved downward in FIG. 1 while maintaining engagement with the first valve element 203, so that the extension 103 moves away from the first valve element 203, and the first vacuum pump chamber **300*a* and the control vacuum chamber 400 are communicated with each other. The control vacuum chamber 400 therefore is gradually brought under the vacuum pressure, which is in turn introduced into the EGR valve 60**, so that the valve element thereof is pulled upward to increase the EGR rate.

Then the second valve element 201 and the first valve element 203 are pulled down in FIG. 1 toward the vacuum pump housing 17, until the pressure of the control vacuum chamber 400 comes into balance with the force exerted by the pressure of the signal vacuum chamber 600. With the increase of the resulting force by the vacuum pressure in the control vacuum chamber 400, the second valve element 201 and the first valve element 203 are gradually raised in FIG. 1. The extension 103 and the first valve element 203 then come into contact with each other, so that the control vacuum chamber 400 is disconnected from the first vacuum pump chamber **300*a***.

If the EGR rate is to be reduced, that is, if the signal vacuum pressure introduced from the vacuum control valve 40 into the signal vacuum chamber 600 is reduced, the second diaphragm 8 is moved upward in FIG. 1 toward the port housing 1, so that the second valve element 201 connected to the connecting shaft 6 is also moved upward in FIG. 1. The jaw portion 202 is, therefore, opened, to communicate the control vacuum chamber 400 with the atmosphere chamber 500. The extension 103 of the first pump vacuum chamber 300*a* is, however, still closed by the first valve element 203. The atmospheric pressure, therefore, flows into the control vacuum chamber 400, and the control vacuum pressure therein is reduced so that the first diaphragm 5 is moved downward in FIG. 1 toward the vacuum pump housing 17. The control vacuum pressure is reduced in proportion to the reduced signal vacuum pressure, to close the jaw portion or atmosphere valve 202.

The above explanation relates where the atmospheric pressure is always constant. An explanation of the operation where the atmospheric pressure is changed will now be given.

Figure 2:
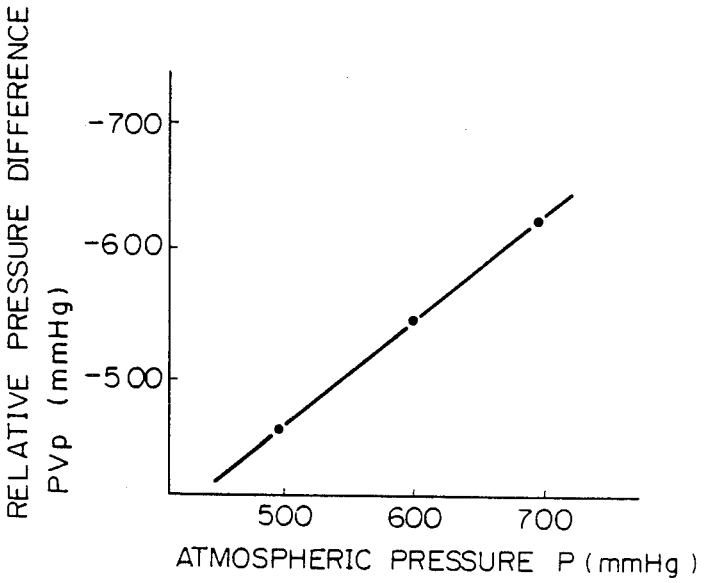
FIG. 2 is a diagram of the relationship between the atmospheric pressure and the relative pressure difference with respect to the vacuum source.

The absolute vacuum pressure obtained by the vane pump 3 used as a vacuum pump is almost unchanged in accordance with the change of the atmospheric pressure. Therefore, the relative pressure difference with respect to the atmospheric pressure is changed substantially linearly with the atmospheric pressure, as shown in FIG. 2. This has been confirmed by experiment. That is, the absolute pressure in the second vacuum pump chamber 300*b* in FIG. 1 is almost unchanged even when the atmospheric pressure changes. Therefore, if the atmospheric pressure is changed, that is, if the pressure in the atmosphere chamber 500 is changed in comparison to the pressure in the second vacuum pump chamber 300*b*, the force pushing the diaphragm 14 is changed in accordance with the change of the pressure in the atmosphere chamber 500, to change in turn the moving distance of the third diaphragm 14. For example, when the atmospheric pressure becomes lower than a normal pressure, the force urging the third diaphragm 14 upward in FIG. 1 toward the port housing 1 is increased so that the third diaphragm 14 is raised in FIG. 1. This force is transmitted in turn through the second spring 81 and the connecting shaft 6 to the servo valve 2. The jaw portion 202 is, therefore, raised away from the first valve element 203 in FIG. 1, creating a gap therebetween, so that the atmospheric pressure is introduced from the atmosphere chamber 500 through the atmosphere communicating port 205 into the control vacuum chamber 400, to reduce the control vacuum. The valve element of the EGR regulator 60 is, therefore, moved downward in FIG. 1 to reduce the EGR rate.

If the atmospheric pressure becomes higher than the normal pressure, the second diaphragm 8 moves downward in FIG. 1 toward the signal vacuum chamber 600, so that the servo valve 2 is moved downward in FIG. 1 to communicate the first vacuum pump chamber 300*a* with the control vacuum chamber 400. The vacuum pressure is introduced through the control vacuum port 102 into the EGR regulator 60 to increase the EGR rate.

The atmospheric pressure compensation system of a vacuum control valve, as mentioned above in the first embodiment of the present invention, makes it possible to reduce the required cost as well as to reduce the necessary space for mounting the valve in an engine compartment, because it is both light weight and compact.

Figure 3:
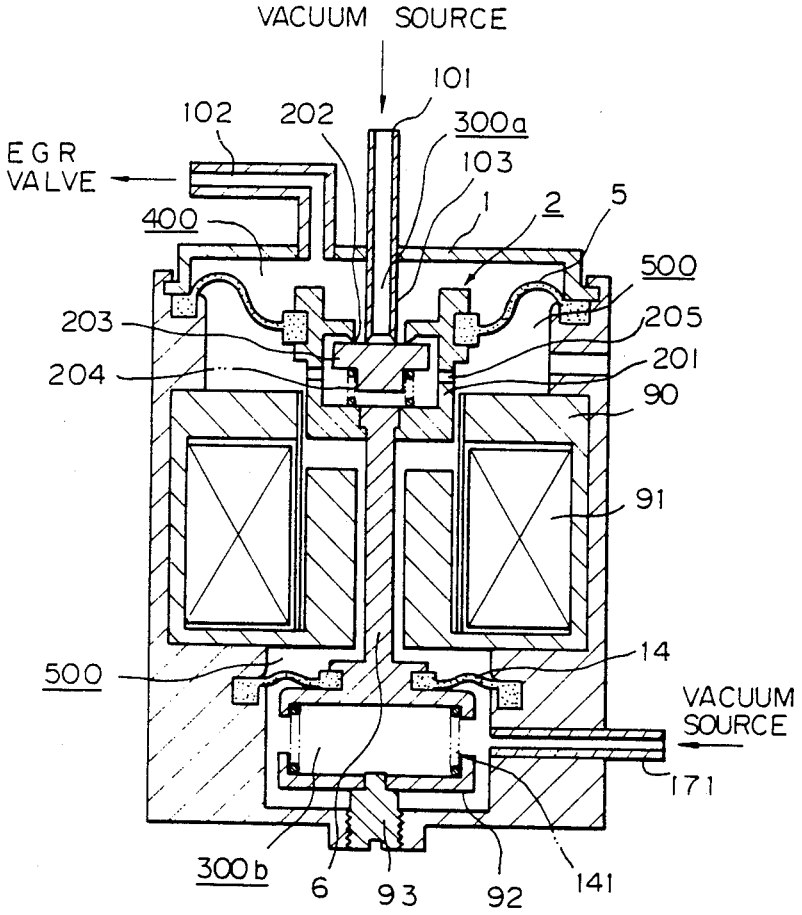
FIG. 3 is a cross-sectional view of a second embodiment of the present invention.

A second embodiment of the present invention will now be described with reference to FIG. 3, wherein a solenoid means is used as an actuator comprising a solenoid 91 and a core 90, as shown in FIG. 3, instead of using the vacuum control valve 40 and the signal vacuum chamber 600 used as an actuator in the above-mentioned first embodiment. The solenoid 91 is energized in accordance with the engine RPM and the quantity of the fuel to pull the servo valve 2 downward in FIG. 3. Therefore, a gap is formed between the extension 103 and the first valve element 203, and vacuum pressure is introduced into the control signal chamber 400. When the force for pulling the servo valve 2 upward in FIG. 3, due to the pressure difference between the control vacuum chamber 400 and the atmosphere chamber 500, becomes larger than the force of the solenoid for pulling the servo valve 2 in FIG. 3, the servo valve 2 is moved upward in FIG. 3 to stop the introduction of vacuum pressure into the control vacuum chamber 400.

When the atmospheric pressure is changed, the same operation as that in the first embodiment is carried out. A third spring 141 is disposed within the second vacuum pump chamber 300*b* and between a connecting shaft 6 and an adjusting plate 92. An adjusting screw 93 is connected to the bottom surface of the adjusting plate 92, and the initial load of the third spring 141 can be adjusted by the adjusting screw 93. According to the second embodiment, parts of the atmospheric pressure compensation, parts of the actuator, and parts of the vacuum control can be integrally constituted, respectively, which enables the system to be made lighter and smaller in size.

Figure 4:
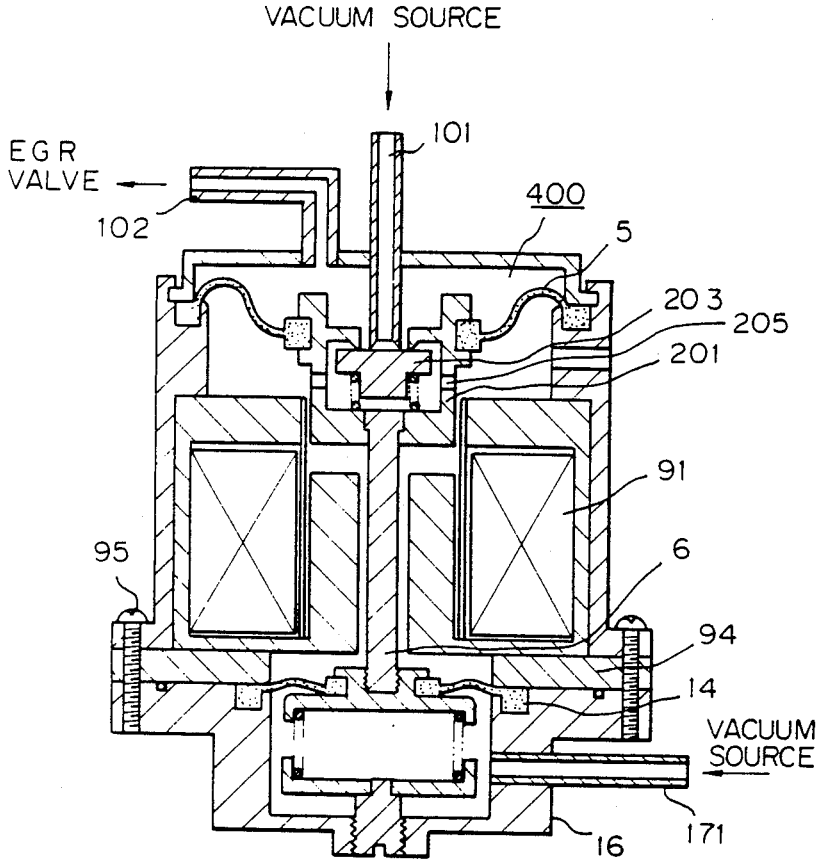
FIG. 4 is a cross-sectional view of a third embodiment of the present invention.

FIG. 4 illustrates a third embodiment of the present invention, wherein components of the atmospheric pressure compensation in the above-mentioned second embodiment are detachably mounted. As seen in FIG. 4, a diaphragm mounting spacer 94 lies between the components of the atmospheric pressure compensation and an actuator, and the components of the atmospheric compensation are mounted on the actuator by means of mounting screws 95. Therefore, by replacing the atmospheric pressure compensation assembly by another assembly, the atmospheric pressure compensation rate or capacity can be easily changed. When atmospheric pressure compensation is not necessary, the assembly can be removed.

Figure 5:
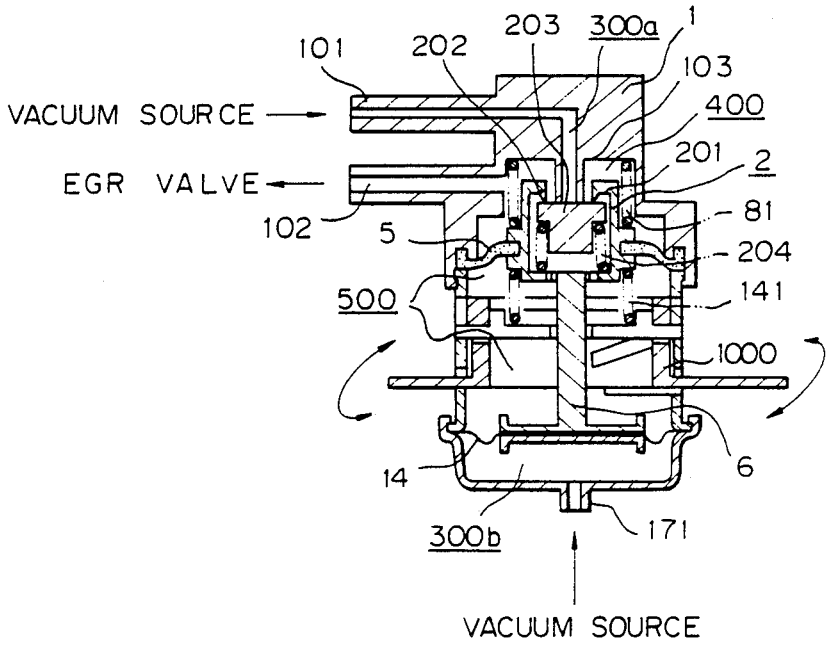
FIG. 5 is a cross-sectional view of a fourth embodiment of the present invention; and, FIG. 6 is a cross-sectional view of a fifth embodiment of the present invention.

FIG. 5 illustrates a fourth embodiment of the present invention, wherein an actuator as in the first embodiment is constituted by a face cam 1000. The face cam 1000 moves downward in FIG. 5 in accordance with an engine RPM signal and the fuel quantity, and the servo valve 2 is moved downward in FIG. 5 due to the downward directed force caused by a third spring 141 connected to the face cam 1000 and a second spring 81. A gap is, therefore, created between the extension 103 and the first valve element 203, to introduce vacuum pressure into the control vacuum chamber 400. When the upward directed force caused by the pressure difference between the control vacuum chamber 400 and the atmosphere chamber 500 becomes larger than the downward directed force of the second and third springs 81 and 141, the servo valve 2 is raised, so that the extension 103 comes into contact with the first valve element 203 to stop the introduction of vacuum pressure into the control vacuum chamber 400. In addition, when the upward directed force caused by the pressure difference between the control vacuum chamber 400 and the atmosphere chamber 500 becomes further larger than the downward directed force of the second and third springs 81 and 141, a gap is created between the jaw portion 202 and the first valve element 203 so as to introduce atmospheric pressure into the control vacuum chamber 400. Where the atmospheric pressure is changed, the same operation as that in the first embodiment is carried out.

Figure 6:
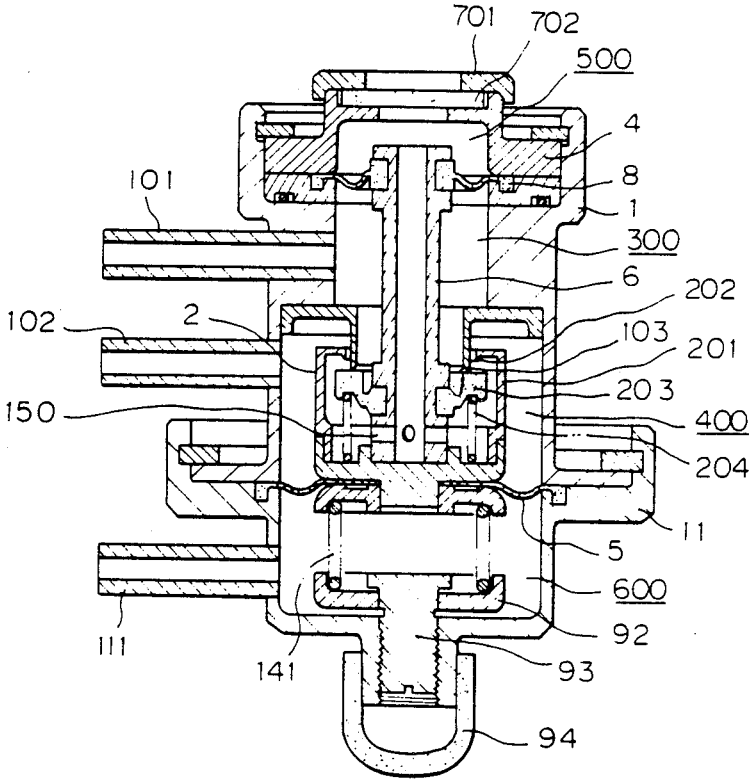

FIG. 6 illustrates a fifth embodiment of the present invention, wherein a vacuum pump chamber 300 via a first valve element 203 is provided at one side of the vacuum control chamber 400, while a signal vacuum chamber 600 via a first diaphragm 5 is provided at the other side thereof. An atmosphere chamber 500 via a second diaphragm 8 is provided adjacent to the above-mentioned vacuum pump chamber 300.

In FIG. 6, the first diaphragm 5 is subjected to four vertical forces, that is, up-to-down directed forces in FIG. 6 consisting of Fa exerted on the second diaphragm 8 by the pressure difference between the atmospheric pressure chamber 500 and the vacuum pump chamber 300 and transmitted through the connecting shaft 14, and Fs caused by the vacuum pressure in the signal vacuum chamber 600 and attracting the first diaphragm 5. On the other hand, down-to-up directed forces in FIG. 6 consist of a force Fc of the third spring 4 and a vacuum pressure force Fo generated in the control vacuum chamber 400.

The pressure in the control vacuum chamber 400 is to be changed by changing the first and second valve elements 203 and 201 of the servo valve 2, to satisfy the following equation regarding the above-mentioned four vertical forces.

$$Fo+Fc=Fa+Fs \quad (1)$$

In the equation (1), if the atmospheric pressure is unchanged, Fa is constant. Therefore, the equation (1) can be represented as follows.

$$Fo+Fc=(Fa)\ \text{const}+Fs \quad (2)$$

This means that the force Fo caused by the control vacuum pressure varies in accordance with the force Fs caused by the signal vacuum pressure. Therefore, for example, if the pressure (vacuum pressure) in the signal vacuum chamber 600 becomes larger, Fs becomes larger. The first diaphragm 5 then moves downward together with the second valve element 201, and the first valve element 203 is engaged therewith and together moved downward. The extension 103 and the first valve element 203 are relatively moved away from each other to communicate the vacuum pump chamber 300 with the control vacuum chamber 400, so that the vacuum pressure in the control chamber 400 gradually becomes larger and larger. The vacuum pressure becomes larger until the equation (2) is satisfied. Meanwhile, the opening of the first valve element 203 becomes smaller and smaller and is finally closed when the equation (2) is satisfied, thereafter being maintained in a closed condition.

To the contrary, if the pressure (vacuum pressure) in the signal vacuum chamber 600 becomes smaller, the second valve 201 is moved upward i.e., in the opposite direction to the above, and the jaw portion 202 of the second valve element 201 is opened so that atmospheric pressure is introduced into the control vacuum chamber 400 to satisfy the equation (2).

In the above-mentioned equation (1), if the vacuum pressure in the signal vacuum chamber 600 is constant, and the pressure in the atmosphere chamber 500 varies, the equation (1) can be represented as follows.

$$Fo+Fc=Fa+(Fs)\ \text{const} \quad (3)$$

Due to the variation of the atmospheric pressure, the relative pressure of the vacuum pump pressure changes with respect to the atmospheric pressure, and the force transmitted through the connecting shaft 6 to the servo valve 2 changes so that the same operation as mentioned above is carried out.

The rate or capacity of the atmospheric pressure compensation can be adjusted by changing the ratio of the effective areas between the first and second diaphragms 5 and 8.

In the above-mentioned several embodiments, a coil spring may be used in place of the connecting shaft 6, or each diaphragm chamber may be constituted as a pressure chamber defined by a cylinder and piston.

As mentioned above, according to the present invention, an atmospheric pressure compensation for an EGR system can be manufactured at a low cost and with simpler technical procedures. The present invention can be used not only in a diesel engine EGR system, but also in any type of internal combustion engine having an EGR system requiring atmospheric pressure compensation.

We claim:

1. An atmospheric pressure compensation system for an exhaust gas recirculation of an internal combustion engine, comprising a vacuum source for generating vacuum pressure of substantially constant absolute value; an EGR valve for regulating the gas flow passing through an EGR passage by means of the vacuum pressure from said vacuum source; an atmospheric pressure compensation valve for opening and closing a passage for transmitting the vacuum pressure from said vacuum source to said EGR valve; a control circuit for detecting the engine running conditions and generating a control signal; an actuator means for contributing to actuate said atmospheric pressure compensation valve in response to said control signal; and said atmospheric pressure compensation valve comprising a valve body defining therein at least two chambers, the atmospheric pressure being introduced into one of said chambers, while the substantially constant vacuum pressure from said vacuum source being introduced into the other chamber, means for movably partitioning between said two pressure chambers, and movable valve means for opening and closing said vacuum transmitting passage, operatively connected to said partitioning means and to said actuator, so that said valve means be subjected to the actuating force of said actuator and the pressure difference between the atmospheric pressure and the substantially constant vacuum pressure.

2. A system as set forth in claim 1, wherein said movably partitioning means comprises at least one diaphragm, and said movable valve means consists of a servo valve, by which said EGR valve is selectively connected to either said constant vacuum source or to the atmosphere through said atmosphere chamber.

3. A system as set forth in claim 2, wherein said servo valve comprises a first valve element, a second valve element movably disposed in the valve body and formed as a casing for movably receiving said first valve element, said casing being communicated with said atmosphere chamber into which the atmospheric pressure is introduced, a spring disposed in said casing for urging said first valve element in one direction within its stroke so as to close said second valve element, which is operatively connected to said diaphragm means as well as to said actuator, said second valve element allowing by its moving in said one direction the first valve element to close a vacuum pump port connected to said constant vacuum source and to open said second valve element introduce the atmospheric pressure into said EGR valve, and allowing by its moving in the other direction the first valve element to open said vacuum pump port to introduce the constant vacuum into said EGR valve and to close said second valve.

4. A system as set forth in claim 3, wherein said actuator means comprises a signal vacuum chamber which is formed within the valve body and between said atmosphere chamber and said constant vacuum pressure chamber, and partitioned therebetween by second and third diaphragms, respectively, and means for introducing a signal vacuum in response to said control signal into said signal vacuum chamber.

5. A system as set forth in claim 3, wherein said actuator means comprises a solenoid means which receives said control signal and actuates a connecting shaft which connects said second valve element to a diaphragm for partitioning said atmosphere chamber and constant vacuum pressure chamber.

6. A system as set forth in claim 3, wherein said actuator means comprises a second spring for exerting a load on said second valve element, and a face cam which is actuated in response to said control signal so as to adjust a set load of said second spring.

* * * * *